US005135462A

United States Patent [19]

Stahlecker et al.

[11] Patent Number: 5,135,462

[45] Date of Patent: Aug. 4, 1992

[54] APPARATUS FOR THE PRODUCTION OF PLASTIC COATED CARDBOARD CAN

[75] Inventors: Werner Stahlecker, Stuttgart; Berthold Müller, Süssen, both of Fed. Rep. of Germany

[73] Assignee: Michael Horauf Maschinenfabrik GmbH & Co. KG, Donzdorf, Fed. Rep. of Germany

[21] Appl. No.: 681,973

[22] Filed: Apr. 18, 1991

[30] Foreign Application Priority Data

May 9, 1990 [DE] Fed. Rep. of Germany ..... 4014774

[51] Int. Cl.[5] ..... B31C 1/06; B31B 17/32; B31B 17/90

[52] U.S. Cl. ..... 493/87; 493/105; 493/109

[58] Field of Search ..... 493/87, 104, 105, 108, 493/109

[56] References Cited

U.S. PATENT DOCUMENTS

| | | | |
|---|---|---|---|
| 1,813,379 | 7/1931 | Berg | 493/107 |
| 1,987,362 | 1/1935 | Cooley | 493/106 |
| 2,135,219 | 11/1938 | Reifsnyder | 493/106 |
| 2,200,276 | 5/1940 | Hothersall et al. | 493/87 |
| 2,409,655 | 10/1946 | Annen | 229/5.6 |
| 2,677,489 | 5/1954 | Hall, Jr. et al. | 229/4.5 |
| 2,737,090 | 3/1956 | Nordquist | 493/105 |
| 2,871,553 | 2/1959 | Binder | 493/87 |
| 3,215,050 | 11/1965 | Schroeder | 493/87 |
| 3,343,465 | 9/1967 | Albert | 493/106 |
| 3,468,013 | 9/1969 | Sciamonte et al. | 493/87 |
| 3,926,098 | 12/1975 | Smith | 493/295 |
| 3,958,501 | 5/1976 | Richards | 493/105 |
| 4,100,842 | 7/1978 | Richards et al. | 493/107 |
| 4,318,703 | 3/1982 | Richards et al. | 493/149 |
| 4,349,345 | 9/1982 | Bodendoerfer | 493/295 |
| 4,490,130 | 12/1984 | Konzal et al. | 493/106 |
| 4,708,706 | 11/1987 | Doderer et al. | 493/295 |
| 4,925,440 | 5/1990 | Muller | 493/295 |
| 4,964,562 | 10/1990 | Gordon | 493/87 |

FOREIGN PATENT DOCUMENTS

| | | |
|---|---|---|
| 3023835 | 1/1981 | Fed. Rep. of Germany . |
| 362968 | 12/1931 | United Kingdom . |
| 704608 | 2/1954 | United Kingdom . |

*Primary Examiner*—William E. Terrell

*Attorney, Agent, or Firm*—Burns, Doane, Swecker & Mathis

[57] ABSTRACT

Empty cans are formed in preparation for being filled. The empty can includes a sleeve and two end walls. One of the end walls contains a filler opening for enabling product to be subsequently inserted into the can and thereafter discharged from the can. The filler openings can be closed by tear strips or screw caps.

9 Claims, 6 Drawing Sheets

APPARATUS FOR THE PRODUCTION OF PLASTIC COATED CARDBOARD CAN

BACKGROUND OF THE INVENTION

The invention concerns methods and apparatus for the production of a plastic coated cardboard can.

German Document DE-30 23 835 shows and describes a can comprising a plastic coated cardboard cylinder with an inner aluminum layer and defining, in the finished state, a sleeve to each of the two open ends of which a frontal or end wall is applied. The known machines for the production of such cans are laid out so that the can is produced initially in the form of a cup having a closed end and an open end into which the filler goods, such as beverages, are inserted. The initial production apparatus therefore comprises only one station for the insertion of a first end wall at the closed end. After filling, the second end wall is inserted in another apparatus. A type of induction welding is used to join the seams, both in case of the first and the second end walls, which requires the use of the aluminum layer. When filled cans are prepared in this manner, it is difficult to insert and connect the second end wall (which may contain a hole closed by tear-off tab for use as a discharging opening for the insertion of a straw), because of interference created by the filler material already in the can, especially as regards wetting the area of the weld seams. That is, a filler material in the form of a liquid produces a humid environment which can penetrate into the area where a seam is to be formed between the end wall and the can sleeve, thereby complicating that welding procedure by making it difficult to attain a proper sealing temperature, etc.

It is, therefore, an object of the invention to provide an apparatus of the afore-mentioned type so that these disadvantages are avoided. In particular, it should be possible in a simple manner to prevent the penetration of humidity, in the case of liquid filler materials, into the area of the can seams prior to sealing. Another object is to provide a method of conveniently making and filling a can.

SUMMARY OF THE INVENTION

The present invention involves methods and apparatus for the production of an empty can from plastic coated cardboard. The apparatus comprises a winding mechanism for winding a sleeve from the plastic coated cardboard, the sleeve having first and second ends. A first wall installing mechanism is provided for inserting and sealing a first end wall on the first end while the sleeve is empty, to form an intermediate can part. A second wall installing mechanism is provided for engaging an outer periphery of the intermediate can part and for inserting and sealing a second end wall on the second end while the intermediate can part is empty, to form an empty can. One of the end walls has a filler opening therein for enabling the empty can to be subsequently filled with product.

Preferably, the apparatus includes a first handling mechanism containing both the winding mechanism and the first wall installing mechanism. The first handling mechanism includes a mandrel on which the sleeve is wound and on which the sleeve is mounted when receiving the first end wall.

The first handling mechanism preferably comprises a star wheel containing a plurality of mandrels. The star wheel is rotated in stepwise fashion from the winding mechanism to the first wall installing mechanism.

The first wall installing mechanism preferably includes a conveyor for conveying a cardboard strip from which the first end walls are formed. The first end wall installing mechanism preferably includes a cutting mechanism for cutting the first end walls from the cardboard strip.

It is preferable that the first end wall installing mechanism includes a bending mechanism for bending an outer peripheral edge of each of the first end walls to form a rim thereon.

The first end wall installing mechanism preferably includes a mechanism for installing a threaded fitting into each of the first end walls to define both the filler opening for the introduction of product into the empty can, and a discharge opening for the subsequent discharge of product from the can.

The winding mechanism preferably includes a mechanism for forming seam on the sleeve and a mechanism for heating and sealing the seams. Each of the first and second end wall installing mechanisms includes a mechanism for forming a seam between the sleeve and respective ones of the first and second end walls and a mechanism for heating and sealing those seams.

A second handling mechanism is preferably provided which contains the second end wall installing mechanism. The second handling mechanism includes an additional star wheel having a mechanism for engaging outer peripheries of the intermediate cans while the second end walls are inserted and sealed thereon.

The second end wall installing mechanism preferably includes an additional conveyor for conveying a cardboard strip from which the second end walls are formed.

The invention also includes a method for the production of empty cans from plastic coated cardboard.

The invention makes it possible to apply the two end walls prior to the filling of the can. The seams may thus be sealed satisfactorily by simple means and it may be sufficient, as in other similar production processes, to use for example hot air for that purpose. There is no risk of the penetration of humidity into the area of the seams from liquid product, so that the required sealing temperatures may be attained without difficulty.

As one of the end walls has a filler opening, the can may be filled later, and the relatively small filler opening may subsequently be satisfactorily sealed without difficulty. It is advantageous that after the sleeve has been provided with the first end wall, it is guided in a holding acting on the outer periphery of the sleeve, so that the can may be handled safely and without difficulty in its empty state until it attains its final condition.

BRIEF DESCRIPTION OF THE DRAWINGS

The objects and advantages of the invention will become apparent from the following detailed description of a preferred embodiment thereof in connection with the accompanying drawings, in which like numerals designate like elements, and in which.

DETAILED DESCRIPTION OF A PREFERRED EMBODIMENT OF THE INVENTION

Figure 1:
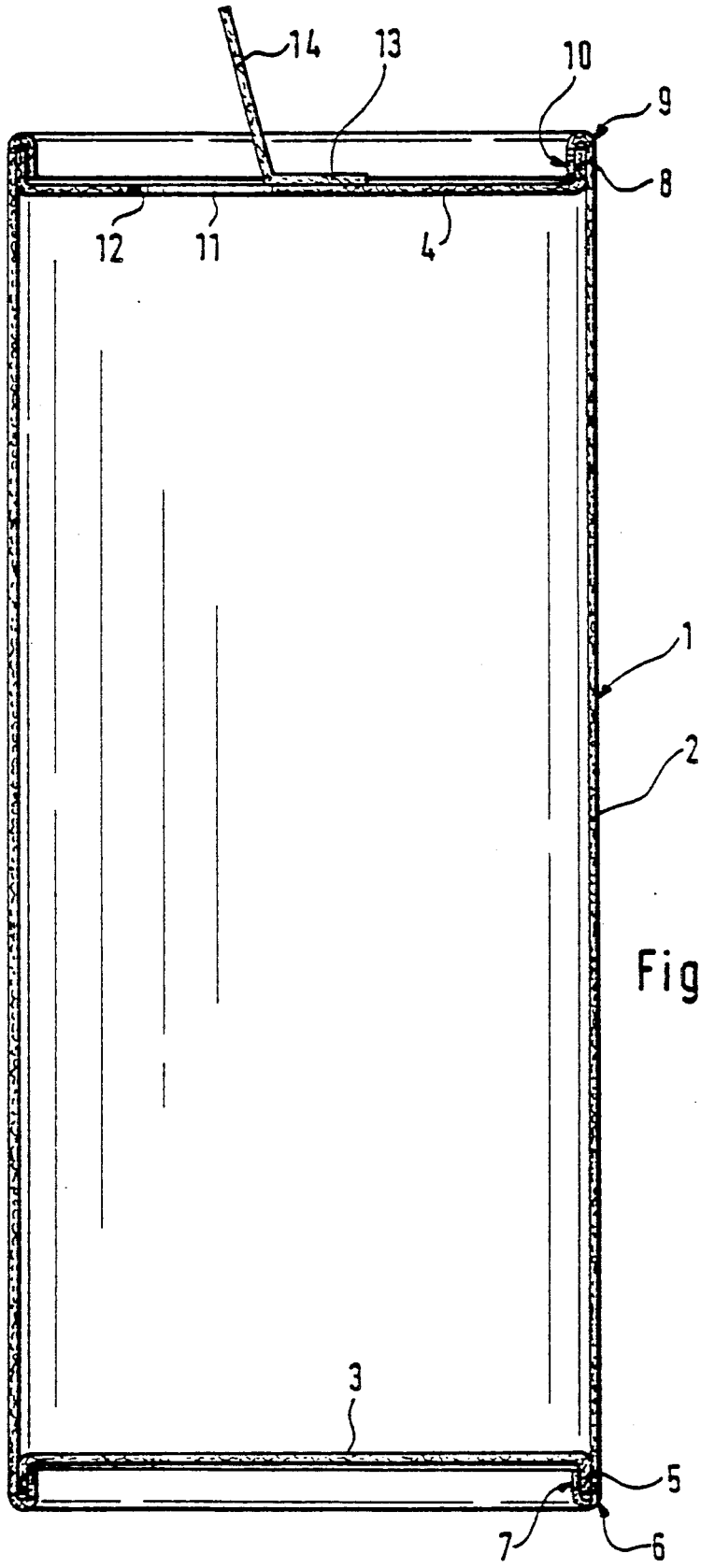
FIG. 1 is a longitudinal sectional view through a first embodiment of a can formed in accordance with the present invention.

FIG. 1 shows a first embodiment of a can 1 produced according to the invention. It comprises a wound sleeve 2, into which the end walls 3, 4 are set. Both the sleeve 2 and the end walls 3, 4 comprise plastic coated cardboard, with an optional aluminum layer embedded thereon.

The end wall 3 forming the bottom of the can is provided with a downwardly projecting rim 5, around which the end 6 of the sleeve 2 is rolled. This produces a seam area 7, which is tightly closed after hot sealing. The hot sealing is performed by an apparatus shown in FIGS. 8 and 9 which is equipped with the proper hot air nozzles.

In a similar manner, the end wall 4 constituting the can lid has an upwardly projecting rim 8, around which the end 9 of the sleeve 2 is rolled. A seam area is therefore formed at the end wall 4, which is tightly sealed by the hot sealing process.

The end walls 3, 4 are set into the sleeve 2 prior to filling the can 1 with a filler material, for example a liquid beverage. For this reason, the end wall 4 has a filler opening 11, which also defines a discharge opening of the can through which a product is to be eventually discharged. The surface 12 of the lid which forms the thickness of the filler opening 11 is sealed by means of a cut edge protection which may be effected for example by a lining of the cardboard that projects foil-like over the surface 12.

The end wall 4 may be provided with a closing element 13 (applied to the wall 4 preferably prior to, or possibly after, the insertion of the wall 4 onto the sleeve) which includes a tear-off tab portion 14 still open at this time. Following the filling of the can 1, the tear-off tab 14 may be closed in a simple manner. Alternatively, a tear-off tab may be applied after the completion of the can 1 but prior to its filling, while the tab remains open.

By virtue of the fact that the end walls 3, 4 are inserted into the sleeve 2 prior to the filling of the can 1, the seam areas 7, 10 may be tightly sealed. No liquid filler material is present to adversely affect the seam area 7, 10 and render the sealing process difficult.

Figure 2:
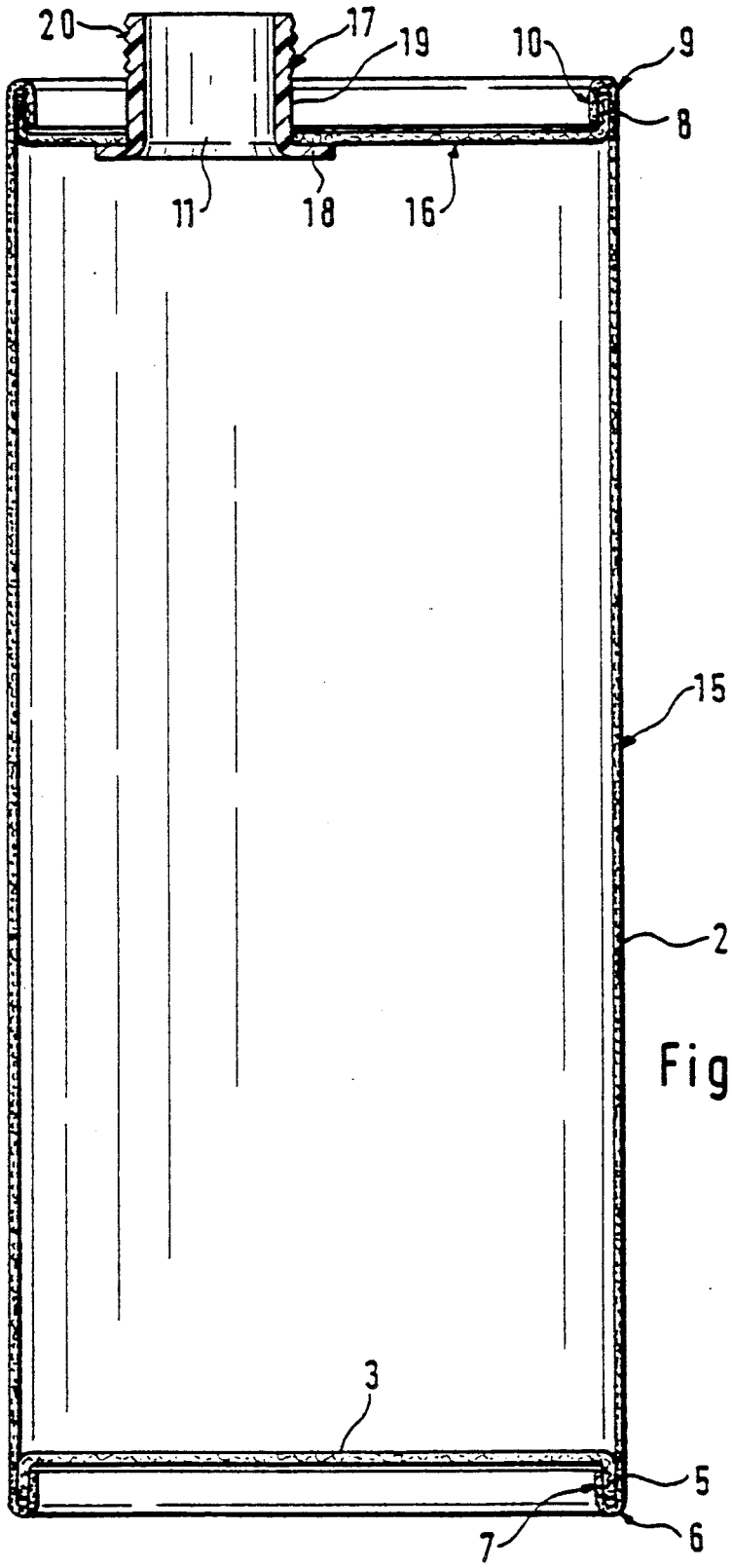
FIG. 2 is a longitudinal sectional view through a second embodiment of a can formed in accordance with the present invention.

A can 15 according to FIG. 2 represents another preferred embodiment of the invention and differs from the can of FIG. 1 essentially in that in the case of the can 15 has a different end wall 16 forming the lid. Even before its insertion into the sleeve 2, a filler fitting 17 is applied to the end wall 16, which later is used to empty the can 15. The filler fitting 17 conveniently comprises a plastic material and is sealed by means of a flange 18 to the end wall 16. A sleevelike section 19 containing the filler opening of the filler fitting 17 has external threads 20, so the full can 15 may be closed later by a screw cap. In this embodiment, it is again possible in a simple manner to sealingly close the seam areas 7, 10 by heat sealing prior to the filling of the can 15.

Figure 3:
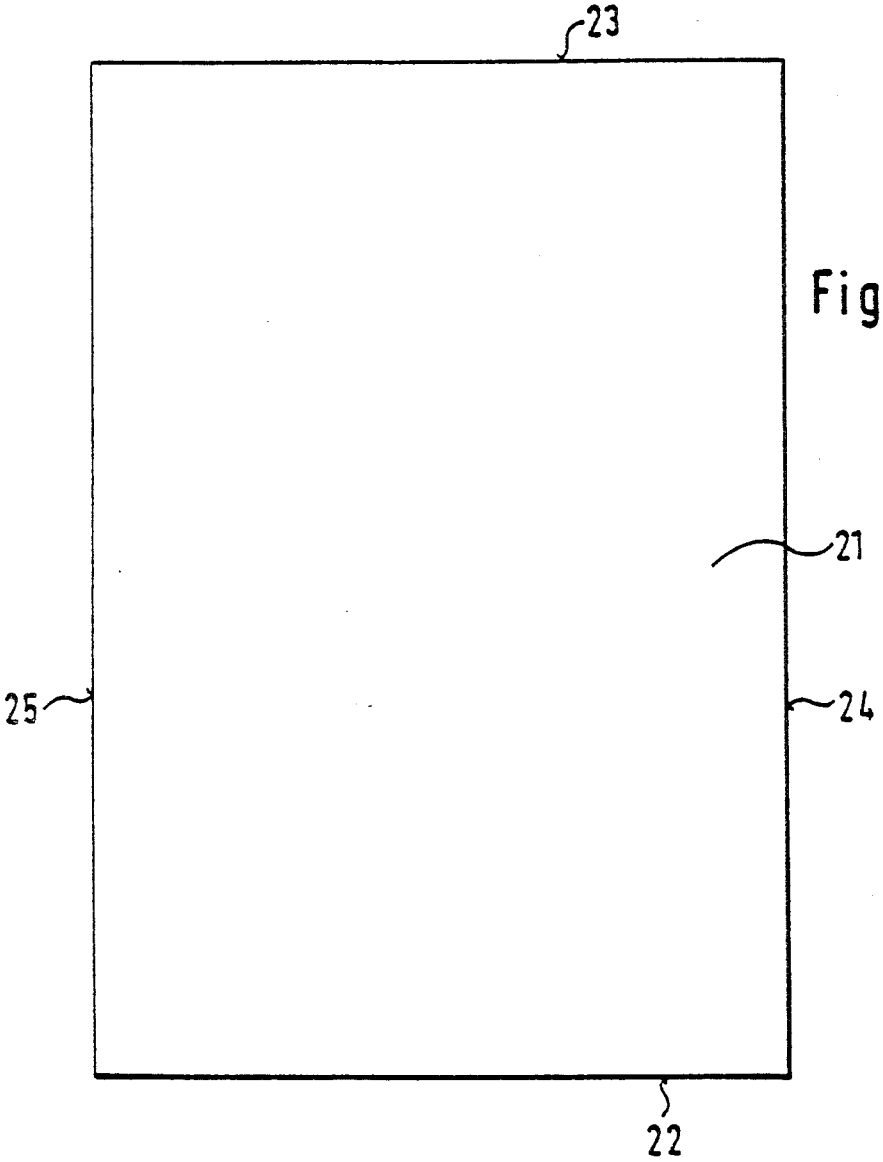
FIG. 3 is a blank of a jacket for forming a sleeve portion of a can according to the present invention.

FIG. 3 shows the precut jacket blank 21 from which the sleeve 2 is wound. The jacket blank 21 is an essentially rectangularly cut blank, the opposing edges 22, 23 of which later form the seam area 26 after the winding of the sleeve 2 (see also FIG. 4), and the other opposing edges 24, 25 of which later form the ends of the sleeve 2.

Figure 4:
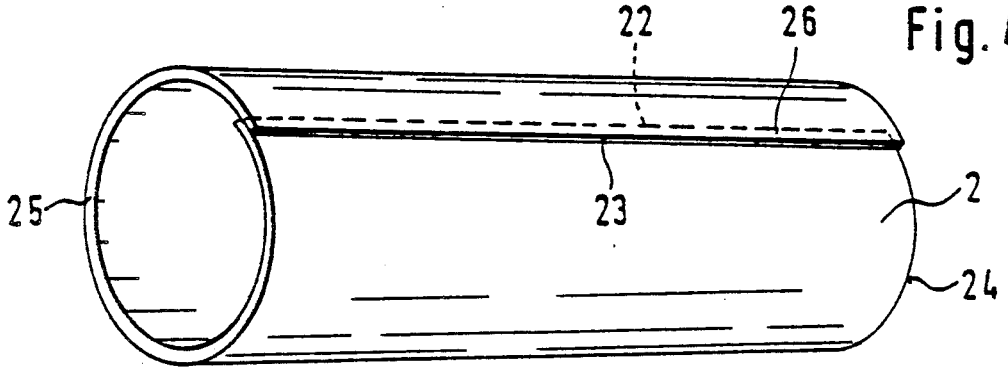
FIG. 4 is a perspective view of a sleeve formed by winding the jacket depicted in FIG. 3.

In FIG. 4 the wound sleeve 2 is depicted. The edges 22, 23 overlap into a seam area 26 which is sealed even prior to the insertion of the end walls 3, 4.

Figure 5:
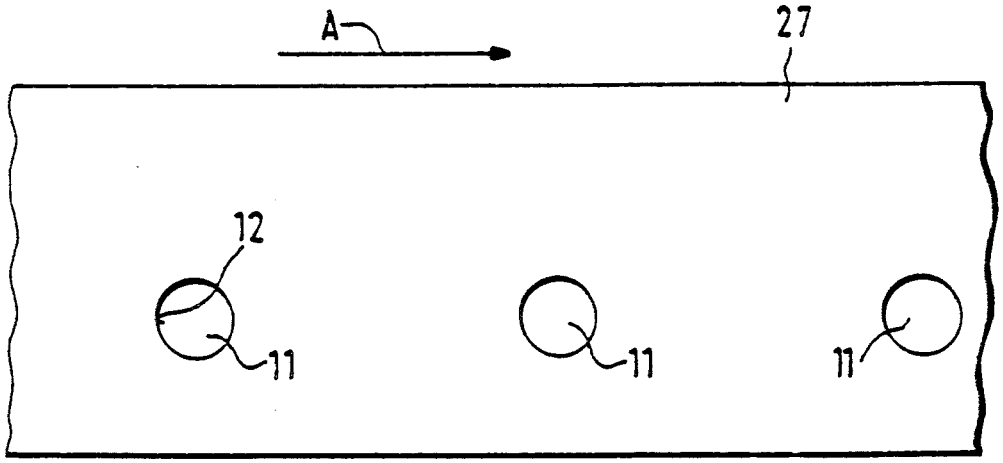
FIG. 5 is a plan view of a strip of cardboard from which the first end walls are cut, the strip including filler openings.

FIG. 5 shows a cardboard strip 27 being transported in the direction of arrow (A) and from which the individual end walls 4 will be made. The cardboard strip 27 is already prepared with the fillet openings 11, so it is not necessary to punch out the openings 11 in the apparatus for the production of a can 1 or 15. It is possible to have already provided the surfaces 12 of the openings 11 with cut edge protection in a suitable manner. It will be appreciated that a device for the punching of the filler openings 11 may also be integrated into the apparatus shown in FIGS. 8 and 9.

Figure 6:
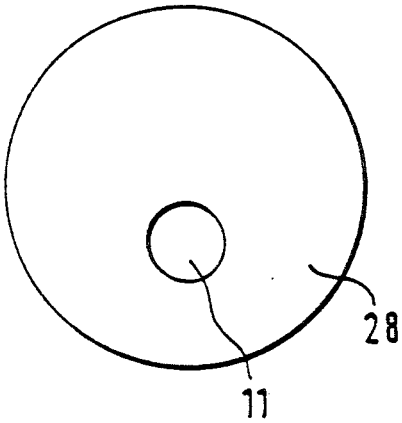
FIG. 6 is a circular blank punched from the cardboard strip of FIG. 5.
Figure 7:
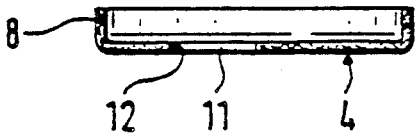
FIG. 7 is a longitudinal sectional view taken through a first end wall after the latter has been bent at its outer peripheral edge to form a rim.

FIG. 6 shows a round blank 28 punched from the cardboard strip 27 during the creation of the end wall 4, the final configuration of which being shown in FIG. 7. The blank 28 contains the filler opening 11 already punched out which optionally may already be provided with cut edge protection, or else, the version with the filler fitting 17 is used, which itself forms the edge protection. FIG. 7 depicts the end wall with the rim 8 formed thereon, e.g., by a drawing operation.

Figure 8:
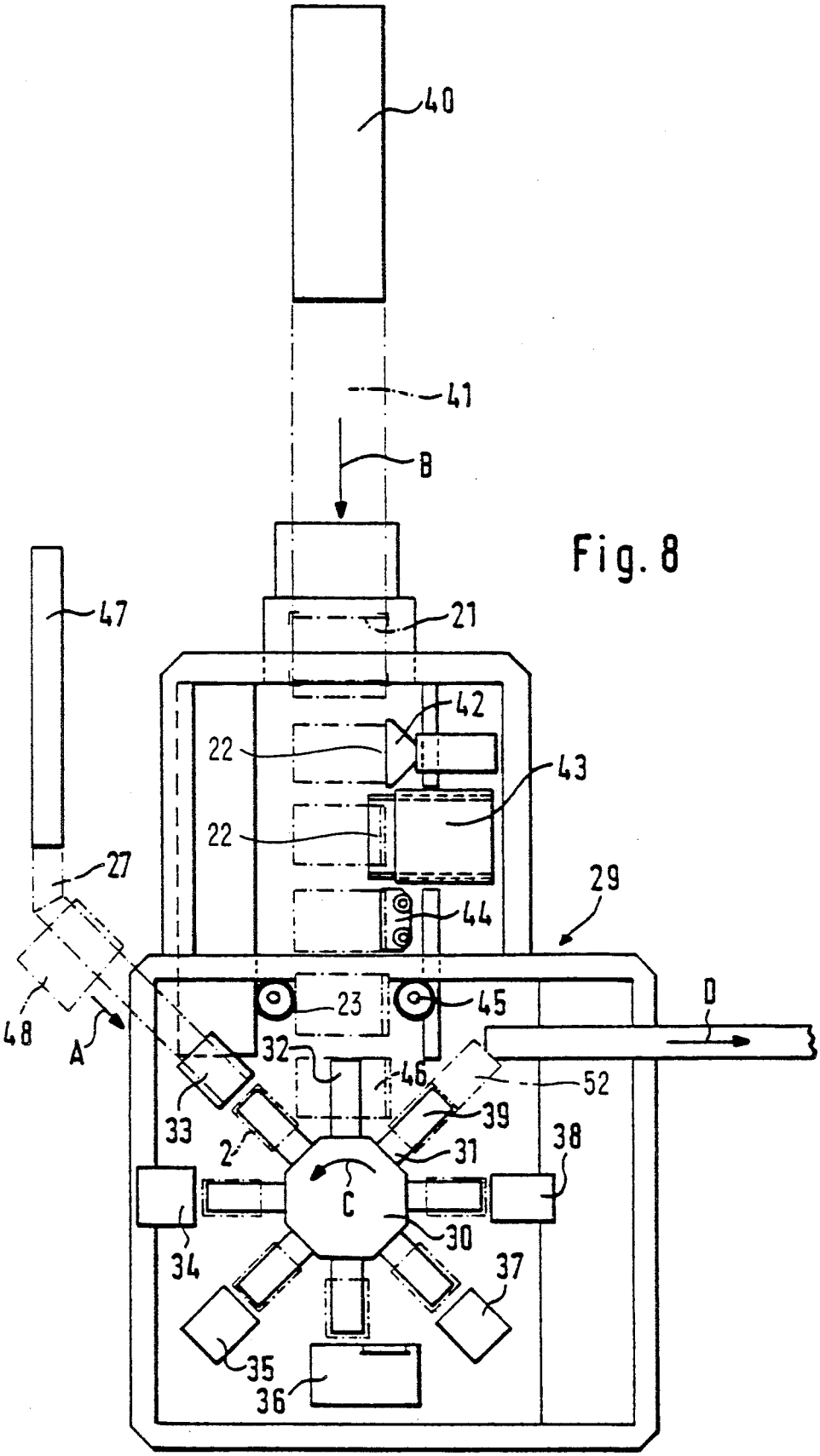
FIG. 8 is a schematic side elevational view of a first section of an apparatus for forming an intermediate can part according to the present invention.
Figure 9:
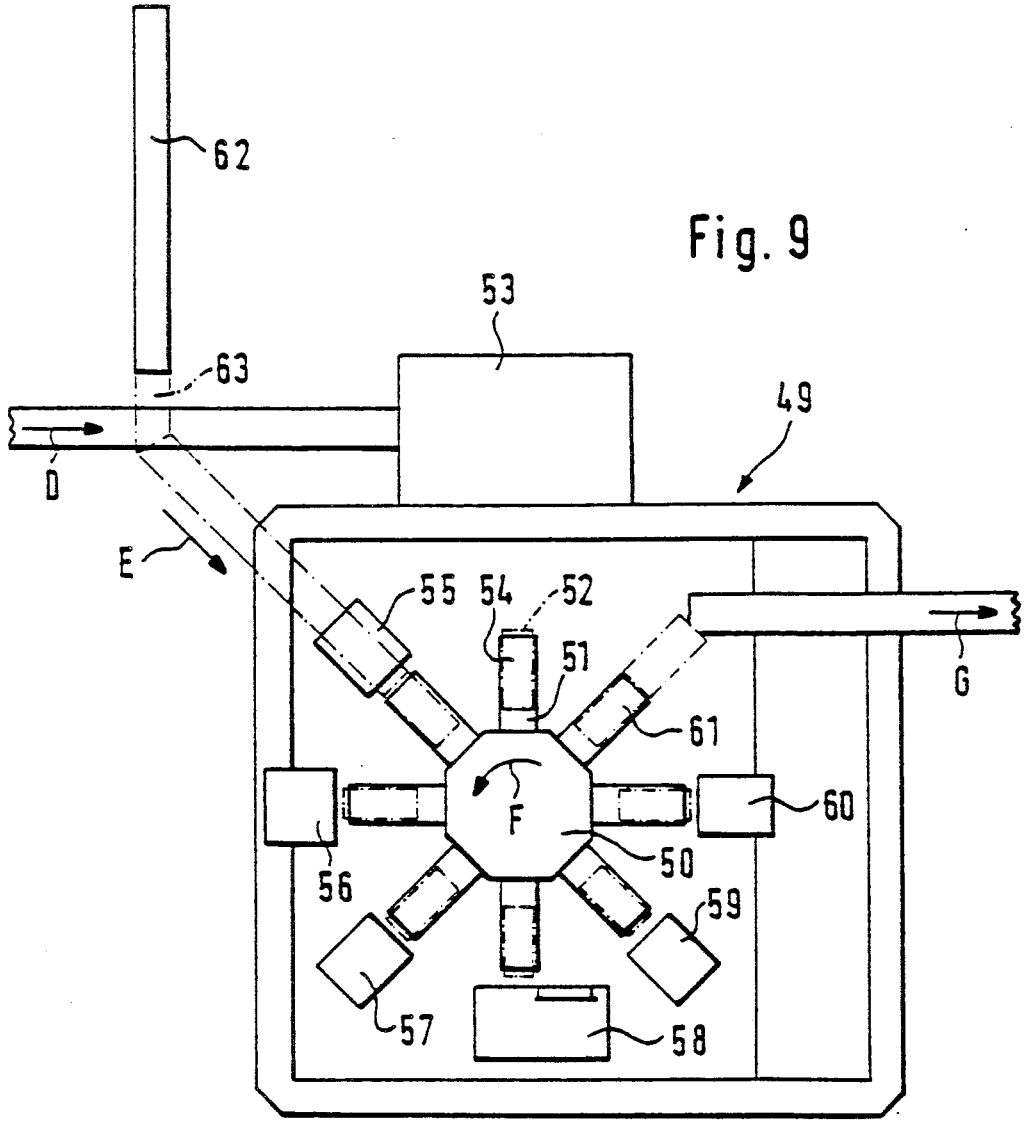
FIG. 9 is a schematic side elevational view of a second section of an apparatus which receives the intermediate can part and forms a final, empty can therefrom.

FIGS. 8 and 9 show an apparatus for the production of cans 1 or 15, with FIG. 8 displaying one handling section 29 of the apparatus, and FIG. 9 displaying a second handling section 49 associated with the first section 29.

The section 29 contains a so-called star wheel 30 that may be advanced or indexed in stepwise fashion in the direction of the arrow C. The star wheel revolves in steps and contains a total of eight mandrels 31 which pass in succession through processing stations 32 to 39.

The section 29 contains a roll 40, which delivers in the direction of the arrow B a cardboard strip 41 indicated by the dash-and-dot line. Following the punching out of a jacket blank 21 from the strip 41, the area of edge 22 that is to later form the longitudinal seam 26 is heated in a heating device 42, so that a conventional apparatus 43 is then able to apply a sealing strip to seal off the cut edge 22 which is eventually exposed to the contents of the can. The area of edge 22 is folded and pre-bent in a preliminary station 44 and again heated along with edge 23 in a station 45 with hot air. A jacket 46 is thereby obtained, the cut edge areas 22, 23 of which are heated sufficiently so that the jacket 46 may be wound around a mandrel 31 into the sleeve shape at the station 32, whereby the seam area 26 is sealed, so that a longitudinal sealing seam of the sleeve 2 is created.

A roll 47 supplies a subsequent processing station 33 with the cardboard strip 27 in the direction of the arrow A. This cardboard strip 27 may be prepared in the manner described relative to FIG. 5. Optionally, the cardboard strip 27 may, prior to reaching the station 33, pass through a station 48 which inserts the filler fittings 17 in the form of threaded plastic flanges. At the station 33, then, the round blanks 28 shown in FIG. 6 are punched out in a punch press, whereupon the rims 8 are formed. The end wall 4 produced in this manner is inserted into the sleeve 2 at the station 33. The sleeve 2 is thereby closed at one end by the end wall 4 (or 16), while the filler opening 11 remains open.

The sleeve 2 on the mandrel 31, into which the end wall 4 (or 16) has been inserted, is then fed to stations 34, 35 at which hot air is applied to heat the end region of the sleeve 2 that is to later form the end seam 10. At the next station 36, the terminal area 9 of the sleeve 2 is rolled around the rim 8 of the end wall 4 (or 16). The following stations 37, 38 serve to form the sealing seam 10 between the sleeve 2 and the rim 8 of the end wall 4 (or 16), with the seam 10 being compressed crosswise (radially). The intermediate can part 52, in the form of a cup 52, can then be pushed off the mandrel 31 in the last station 39 of the partial apparatus 29 and transported in the direction of the arrow D.

FIG. 9 shows the section 49, and the feeder path of the intermediate can part 52 moving in the direction of the arrow D is depicted. The intermediate can parts 52 are initially separated in a device 53 and transferred to the star wheel 50 revolving in stepwise fashion in the direction of the arrow F, and are inserted into a sleeve-like external holder 51 which contacts the outer periphery of each of the intermediate can parts 52. As an intermediate can part 52 is somewhat more difficult to manipulate in an external holder 51, than a sleeve 2 on a mandrel 31, it is convenient to apply the end wall 3 since that end wall 3 is simpler in its configuration than the end wall 4 (or 16).

The end wall 3 forming the can bottom is inserted into the intermediate can part 52 in the next station 55. A roll 62 is provided for the purpose, from which a cardboard strip is drawn and supplied to the station 55 in the direction of the arrow E. The station 55 contains a punch press, in which the round blank for the front wall is punched and drawn, i.e., the rim 5 is formed. In this station 55 the end wall 3 is set into the intermediate can part 52.

The subsequent stations 56, 57 heat the seam area 7 with hot air. In the station 58, the terminal section 6 of the sleeve 2 is rolled around the rim 5 of the end wall 3. The following stations 59, 60 again form the sealing seam 7, which is compressed crosswise. In the last station 61 the finished can 1 (or 15) is pushed off and conveyed to a filling station (not shown) in the direction of the arrow G.

At the filling station, the product such as a beverage, is inserted into the cans through the filler openings 11. Thereafter, the filling openings are closed and sealed, such as by applying the closing elements 13, 14 across the opening, or attaching a threaded cap to the threaded fittings 17.

Since the product is inserted into the can after both end walls 3, 4 (or 3, 16) have been installed and connected, the insertion and connection of both end walls can be effected easily and without the usual problems created by the presence of the product.

Although the present invention has been described in connection with a preferred embodiment thereof, it will be appreciated by those skilled in the art that additions, modifications, substitutions, and deletions not specifically described may be made without departing from the spirit and scope of the invention as defined in the appended claims.

What is claimed is:

1. Apparatus for the production of a can, comprising:

a first star wheel rotatable about a first axis and comprising a plurality of radially projecting mandrels, blank supplying means for supplying blanks of plastic-coated cardboard onto successive ones of said mandrels, winding means for winding each blank into the shape of an open-ended sleeve around its respective mandrel, first and second end wall installing means arranged for receiving, respectively, first and second end walls formed of plastic-coated cardboard, one of said first and second end walls including a filler opening, said first end wall-installing means arranged to insert said first end walls onto respective ones of said sleeves in a radial direction with respect to said first axis while an inside surface of said sleeve is supported by a respective mandrel, and a second star wheel rotatable about a second axis and comprising a plurality of radially projecting holders each adapted to receive therein one of said sleeves from said first star wheel such that an end of said sleeve closed by said first end wall is located radially inwardly of an opposite sleeve end, said opposite sleeve end being oriented for receiving a second end wall, said second end wall installing means being arranged to insert said second end walls onto respective sleeves in a radial direction with respect to said second axis while an inside surface of said sleeve is supported by a respective holder.

2. Apparatus according to claim 1, wherein said first star wheel is rotatable to displace each mandrel circumferentially from a blank-winding station to an end wall-applying station.

3. Apparatus according to claim 1, wherein said first end wall installing means includes conveyor means for conveying a cardboard strip from which said first end walls are formed.

4. Apparatus according to claim 3, wherein said first end wall installing means includes cutting means for cutting said first end walls from said strip.

5. Apparatus according to claim 4 including bending means for bending an outer edge of each of said first end walls into a folded edge upon the insertion of said first end wall onto said sleeve.

6. Apparatus according to claim 5, wherein said first wall installing means includes means for installing a threaded fitting into said one of said first and second end walls to define both a filler opening for the introduction of product into said empty can, and a discharge opening for the subsequent discharge of product from the can.

7. Apparatus according to claim 1 including hot air nozzles for heating and sealing a seam of each sleeve following the winding thereof.

8. Apparatus according to claim 1 including a feeder conveyor for conveying sleeves from said first star wheel to said second star wheel.

9. Apparatus according to claim 1, wherein said second end wall installing means includes conveyor means for conveying a cardboard strip from which said second end walls are formed.

* * * * *

UNITED STATES PATENT AND TRADEMARK OFFICE

CERTIFICATE OF CORRECTION

PATENT NO. : 5,135,462

DATED : August 4, 1992

INVENTOR(S) : Werner STAHLECKER et al

It is certified that error appears in the above-identified patent and that said Letters Patent is hereby corrected as shown below:

Title page, item

[22] Filed: please delete "Apr. 18, 1991" and insert therefor --Apr. 8, 1991--.

Signed and Sealed this

Twenty-fourth Day of August, 1993

*Attest:*

*Attesting Officer*

BRUCE LEHMAN

*Commissioner of Patents and Trademarks*